United States Patent [19]

Petersen

[11] Patent Number: 4,809,423

[45] Date of Patent: Mar. 7, 1989

[54] MAKING SEAMLESS STEEL PIPES

[76] Inventor: Ulrich Petersen, Inselstrasse 20, D-4000 Duesseldorf, Fed. Rep. of Germany

[21] Appl. No.: 789,704

[22] Filed: Oct. 21, 1985

[30] Foreign Application Priority Data

Oct. 19, 1984 [DE] Fed. Rep. of Germany ..... 3438395

[51] Int. Cl.[4] ..... B21B 19/06

[52] U.S. Cl. ..... 29/527.7; 72/96; 72/367

[58] Field of Search ..... 72/97, 96, 367, 368; 29/527.7

[56] References Cited

U.S. PATENT DOCUMENTS

| | | | |
|---|---|---|---|
| 324,118 | 8/1885 | Kellogg | 29/527.7 |
| 401,143 | 4/1889 | Flagler | 72/97 |
| 605,027 | 5/1898 | Stiefel | 72/97 |
| 1,712,972 | 5/1929 | Stiefel | 72/97 |
| 1,858,920 | 5/1932 | Dunn | 72/97 |
| 1,973,687 | 9/1934 | Moise | 72/97 |
| 2,025,439 | 12/1935 | Brownstein | 72/234 |
| 2,306,771 | 12/1942 | Bannister | 29/527.7 |
| 3,581,384 | 6/1971 | Petersen et al. | 29/527.7 |
| 3,673,836 | 7/1972 | Petersen et al. | 29/527.7 |
| 4,091,524 | 5/1978 | Kocks | 29/527.7 |

OTHER PUBLICATIONS

The Making, Shaping and Treating of Steel, by United States Steel Corp., 1957, pp. 743–744.

*Primary Examiner*—Lowell A. Larson
*Attorney, Agent, or Firm*—Ralf H. Siegemund

[57] ABSTRACT

A method of forming seamless metal tubing and pipes of large diameter in excess of 500 mm diameter. A thick-walled hollow body is made by continuous casting. Rolling the continuously cast hollow body over a mandrel in an oblique rolling mill to the desired weight per unit length. Radially expanding the rolled hollow body while maintaining its weight per unit length.

1 Claim, 1 Drawing Sheet

MAKING SEAMLESS STEEL PIPES

BACKGROUND OF THE INVENTION

The present invention relates to the manufacture and making of seamless steel pipes or tubes of large diameter wherein the term "large diameter" is to mean a tube or pipe having an outer diameter exceeding about 500 mm.

Steel pipes of large diameter within the stated definition are used, for example, in pipelines and for this purpose they are almost exclusively made by welding. The reason for employing welding in this field is essentially traceable to the fact that this method is very economical and particularly compares favorably economically with seamless pipes of comparable dimensions. Nevertheless, it is desirable to use for many fields of employment steel pipes of large diameter which are, in fact, seamless. This is so because any welding seam poses a certain degree of risk and uncertainty about the integrity of the seam, having in mind that problems may arise during installation as well as during operation. Basically, welding seams pose always a certain strength problem whereby in addition to the manufacture of pipes or tubes by way of welding certain additional costs and expenses are incurred for monitoring and controlling the welding, and particularly the welding seam. Also certain finishing work such as a temperature treatment is needed.

Methods are also known which use rather large hollows, and tubes or pipes are rolled therefrom. Certain technical and economical problems arise here, particularly as far as the manufacture of the hollow blanks are concerned. Also one needs special and rather extensive and expensive rolling mills for carrying out the procedure.

Another method has been proposed in which, again, one begins with hollows made in this case through continuous casting and a multiroll mill with obliquely oriented rolls is used to roll the hollow into the final dimensions of the tube and pipe to be made. This method, however, is suitable only for tubing or pipes of certain maximum/average dimensions because the deformation work, even if carried out in several passes, bears certain technical risks, particularly if one wants to make tubing or pipes of a large diameter within the meaning defined above, i.e., with diameters in excess of 500 mm., with additional problems arising if the length of such pipe exceeds 10 meters. One will need, indeed, very expensive rolling mills as well as expensive test procedures in order to avoid or suppress the formation of cracks or deviation from the desired dimensions.

DESCRIPTION OF THE INVENTION

It is an object of the present invention to provide a new and improved method for making seamless steel pipes of large diameter overcoming the deficiencies and avoiding the drawbacks mentioned above.

In accordance with the preferred embodiment of the present invention, the combination of the following steps is suggested. First, hollows are made through continuous casting as is known per se. These hollows are used in a known rolling mill using oblique rolls and a mandrel under tension for rolling the hollows down to the desired dimensions in terms of a particular weight per unit length. Next, the rolled hollow is radially expanded under at least approximately maintaining the weight per unit length, i.e., without axial stretching, using a known expansion mill but working with a mandrel which is under tension so as to obtain the final dimensions of the tubing or pipe to be made.

The inventive combination of these method steps renders possible the manufacture of seamless pipe of large diameter and in an economical fashion, avoiding therefore the known risks of large welded pipes, the risks resulting from the uncertainty inherent in the welding seam. This is of particular importance for those kinds of tubes in which the material used is a steel which is very difficult to weld of which is expected to experience very high internal pressure. Also, the inventive method is of particular advantage for tubing to be used in difficult climatic situations and/or wherein the installation cannot count on a particular careful handling.

DESCRIPTION OF THE DRAWING

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now with the detailed description of the drawings, FIG. 1 illustrates a so-to-speak input unit 1 being comprised of a steel and foundry work together with a machine for continuous casting of slab ingots. The output product of unit 1, so to speak, is a slab ingot 2, i.e., an ingot with a rectangular cross-section. This ingot will be subjected to an intermediate heating step and is then fed to a sheet or scelp rolling mill 3. After sizing and trimming, sheet or plate stock, or scelp, is made to be used for making welded tubing. For final tube production, one will use a large tube work constituted, for example, by a so-called U-press wherein the heated scelp or plate stock is flanged in longitudinal direction so as to assume a U-shaped cross-section. This U-shaped body will then be bent in a so-called O-press into a round tube with abutting edges which are subsequently longitudinally welded along the joint line. Thereafter the tube is heat treated and gauged, which then completes the pipe making. These last steps are symbolized by and in the box 5. The result is a welded pipe or tube 6 of large diameter.

Figure 1:
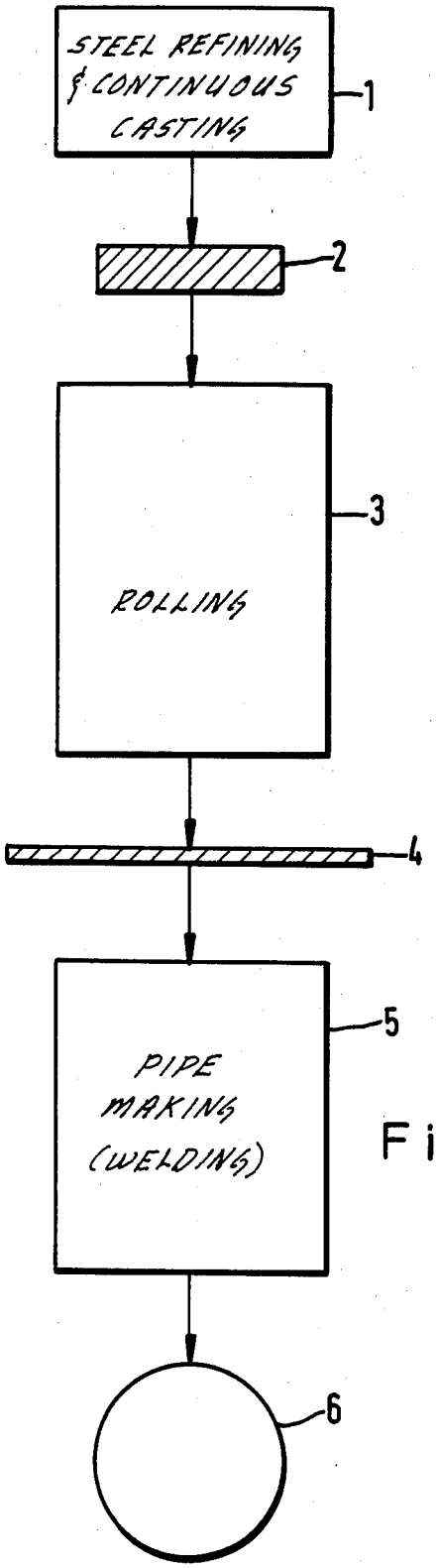
FIG. 1 is a flowchart illustrating the known method of making a large pipe using welding.
Figure 2:
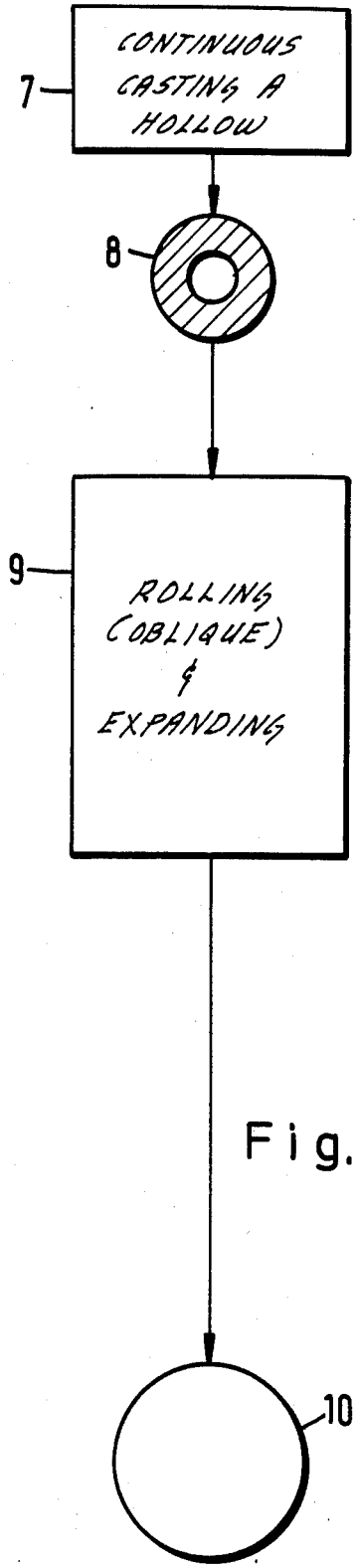
FIG. 2 is a flowchart drawn for comparison with FIG. 1 and illustrating practicing of the method in accordance with the preferred embodiment of the present invention for practicing the best mode thereof.

Proceeding, now, to the description of FIG. 2, the first manufacturing stage is symbolically represented by box 7 and includes also a steel work cooperating with a known machine for continuous casting of hollows. The output product of this particular stage is a round, thick-walled, hollow steel body represented by reference numeral 8 in the drawing. This hollow may have any length, owing to the continuous manufacturing process.

After possible reheating, which may or may not be necessary, the hollow 8 is fed to an oblique rolling mill 9 having as its principal task to manufacture a tube or pipe at the desired final length. This rolling mill with oblique rolls is known, per se, and it is assumed that the mandrel used therein is under tension during the rolling process.

The thus stretched hollow will be fed to one or several serially or sequentially operating expansion mills, using in each instance a mandrel rod which is under tension. This expansion process has as its single task to provide the hollow with the desired wall thickness and diameter so that any stretching will occur only in tangential direction, while the axial dimensions are retained. This means, then, that the weight per unit length remains the same, or one can also say that the diameter increase of the hollow must be accommodated by the commensurate reduction in wall thickness without additional axial flow. In other words, the oblique rolling mill in this arrangement provides for such a stretching so that per unit length the resulting weight, i.e., the then existing wall thickness and diameter, suffices to obtain the desired final wall thickness by widening the hollow to the desired diameter.

Also, the final dimensions are obtained in a sizing mill or an expander. Once the final dimensions are obtained and following gauging, a seamless tube 10 is provided whose dimensions are quite comparable with those made by welding, depending on the type of deformation stages being used and depending further on the particular hollow that emerges from the machine for continuous casting of such a hollow. It is conceivable to obtain dimensions without particular problems wherein, in terms of the length of the large pipe as well as under consideration of diameter and wall thickness, the pipes made in accordance with the new method are quite superior to conventionally made large welded pipes. Also, it is feasible to use the method in accordance with the invention pipes for making pipes of very high grade steel whereby this particular method is more economical and safer, owing to the absence of risks inherent in welding.

Particular advantages of the novel method are to be seen, therefore, in a relatively low investment in equipment as well as in a low level of energy expenditure, particularly as compared with welded pipes of comparable dimension. This means that it is feasible to manufacture large pipes in a economically feasible fashion without the risk of a welding seam. The equipment used permits variation in the dimensions particularly as far as the length of the tubing is concerned. This is over and above the advantage of processing high grade steel which is difficult to weld.

The invention is not limited to the embodiments described above but all changes and modifications thereof, not constituting departures from the spirit and scope of the invention, are intended to be included.

I claim:

1. Method for manufacture of seamless tubing and pipes of large diameter in excess of about 500 mm diameter, comprising the combination of the following steps:

making a hollow by means of continuous casting and cutting a particular length from that casting;

rolling the hollow in a known rolling mill with oblique rolls and under further utilization of a mandrel being tensioned to obtain a hollow in which the weight per unit length equals, at least approximately, the weight per unit length of the final product to be made; and radially expanding said rolled hollow under at least approximate maintaining of the weight per unit length and without axial stretching, under utilization of an expansion mill to obtain the desired final dimensions in terms of wall thickness and diameter of the large tube or pipe to be made.

* * * * *